US009650196B2

(12) United States Patent
Habib

(10) Patent No.: US 9,650,196 B2
(45) Date of Patent: May 16, 2017

(54) VACUUM PACKAGING

(71) Applicant: Timeless Food Technologies Ltd., Ramat Gan (IL)

(72) Inventor: Michel Habib, Ramat Gan (IL)

(73) Assignee: Timeless Food Technologies Ltd., Ramat Gan (IL)

( * ) Notice: Subject to any disclaimer, the term of this patent is extended or adjusted under 35 U.S.C. 154(b) by 0 days.

(21) Appl. No.: 13/897,409

(22) Filed: May 19, 2013

(65) Prior Publication Data

US 2013/0313253 A1 Nov. 28, 2013

Related U.S. Application Data

(60) Provisional application No. 61/651,067, filed on May 24, 2012.

(51) Int. Cl.

| | |
|---|---|
| ***B65D 1/36*** | (2006.01) |
| ***B65D 1/42*** | (2006.01) |
| ***B65D 81/20*** | (2006.01) |
| ***B65D 85/36*** | (2006.01) |
| *B65D 1/44* | (2006.01) |

(52) U.S. Cl.
CPC ..... *B65D 81/2015* (2013.01); *B65D 85/36* (2013.01); *B65D 2585/366* (2013.01)

(58) Field of Classification Search
CPC ..... B65D 81/2015; B65D 85/36; B65D 2585/366
USPC ... 220/780, 4.21, 507, 782, 653, 555, 366.1, 220/669; 206/565
See application file for complete search history.

(56) References Cited

U.S. PATENT DOCUMENTS

| | | | | |
|---|---|---|---|---|
| 3,655,110 | A * | 4/1972 | Eisenbach | 229/406 |
| 4,685,274 | A | 8/1987 | Garwood | |
| 5,984,130 | A * | 11/1999 | Hayes et al. | 220/574 |
| 6,042,856 | A * | 3/2000 | Sagan et al. | 426/87 |
| 7,398,882 | B2 * | 7/2008 | Barrett et al. | 206/521.15 |
| D592,076 | S * | 5/2009 | Sipe et al. | D9/756 |
| D592,077 | S * | 5/2009 | Sipe et al. | D9/756 |
| 8,083,084 | B2 * | 12/2011 | Vovan | 220/4.24 |
| D661,601 | S * | 6/2012 | Sanfilippo | D9/756 |
| 2003/0108643 | A1 | 6/2003 | Hornsby et al. | |

(Continued)

FOREIGN PATENT DOCUMENTS

| | | |
|---|---|---|
| EP | 0748746 A1 | 12/1996 |
| EP | 1866214 B1 | 6/2010 |

(Continued)

OTHER PUBLICATIONS

Supplementary European Search Report for corresponding EP application 13793578 mailed on Nov. 13, 2015.

(Continued)

*Primary Examiner* — J. Gregory Pickett
*Assistant Examiner* — Niki M Eloshway
(74) *Attorney, Agent, or Firm* — Eitan, Mehulal & Sadot

(57) ABSTRACT

A vacuum sealable container for baked or cooked food, the container comprising a tray and a cover correspondingly fitting onto the tray, the tray and the cover including one or more curved-shaped load bearing units. The load bearing units resist deformation when an interior of the container is at a pressure associated with a package sealing vacuum and when an exterior of the container is at ambient atmospheric pressure.

15 Claims, 11 Drawing Sheets

(56) References Cited

U.S. PATENT DOCUMENTS

| | | | | |
|---|---|---|---|---|
| 2004/0134920 | A1* | 7/2004 | Baron | 220/653 |
| 2005/0145638 | A1* | 7/2005 | Van Handel et al. | 220/782 |
| 2009/0100802 | A1 | 4/2009 | Bush | |
| 2009/0142454 | A1 | 6/2009 | Clark et al. | |
| 2010/0181318 | A1* | 7/2010 | Bava et al. | 220/378 |
| 2011/0180446 | A1* | 7/2011 | Kidd et al. | 206/509 |
| 2013/0004625 | A1* | 1/2013 | Brummer et al. | 426/119 |

FOREIGN PATENT DOCUMENTS

| | | |
|---|---|---|
| GB | 593653 | 10/1947 |
| WO | 03076302 | 9/2003 |

OTHER PUBLICATIONS

International Search Report for corresponding PCT application PCT/IB2013/054101 mailed on Oct. 15, 2013.

* cited by examiner

VACUUM PACKAGING

CROSS-REFERENCE TO RELATED APPLICATIONS

This application claims benefit from U.S. Provisional Patent Application No. 61/651,067, filed 24 May 2012, which is hereby incorporated in its entirety by reference.

FIELD OF THE INVENTION

The present invention relates to the packaging of food products generally and in particular, to vacuum packaging of food products.

BACKGROUND OF THE INVENTION

Vacuum packaging is known in the art and provides a convenient solution for extending the shelf life of foods and/or reducing the volume of the package. Vacuum packaging involves removal of air from the package prior to sealing. It reduces the amount of atmospheric oxygen in the packaging and thus inhibits the growth of aerobic bacteria or fungi. It is used for storage of dry foods, such as cereals or coffee, over a long period of time and for storage of fresh foods, such as vegetables, over a shorter period of time. Vacuum packaging comes in various shapes and can be rigid or flexible.

SUMMARY OF THE PRESENT INVENTION

There is provided, according to an embodiment of the present invention, a vacuum sealable container for baked or cooked food, the container includes a tray and a cover correspondingly fitting onto the tray. The tray and/or the cover includes one or more curved-shaped load bearing units which resist deformation when an interior of the container is at a pressure associated with a package sealing vacuum and when an exterior of the container is at ambient atmospheric pressure.

According to an embodiment of the present invention, the container further includes reinforcement ribs for supporting the one or more load bearing units.

According to an embodiment of the present invention, the reinforcement ribs include a cross-section shaped in the form of a U-shape, a T-shape, an L-shape, a circle, or a polygon.

According to an embodiment of the present invention, the container further includes circular reinforcement units for supporting the reinforcement ribs.

According to an embodiment of the present invention, the circular reinforcement units are placed at the intersection of at least two reinforcement ribs.

According to an embodiment of the present invention, the tray and/or the cover includes scalloped-shaped edges along its perimeter.

According to an embodiment of the present invention, the load bearing units resist deformation when a pressure differential between the interior package sealing vacuum and the external ambient pressure is approximately 1 kg/cm2.

According to an embodiment of the present invention, the tray and the cover are formed from a plastic material.

According to an embodiment of the present invention, the plastic material is transparent.

According to an embodiment of the present invention, the plastic material is colored.

According to an embodiment of the present invention, the tray and the cover include rims.

According to an embodiment of the present invention, the tray and the cover include a unit for aligning one with the other.

According to an embodiment of the present invention, the container includes one or more pins, rods, or blades for penetrating into the food.

According to an embodiment of the present invention, the container includes a rectangular shape.

According to an embodiment of the present invention, the container includes a round shape.

According to an embodiment of the present invention, a perimeter of the curved-shaped load bearing units is square-shaped.

According to an embodiment of the present invention, a perimeter of the curved-shaped load bearing units is pie-shaped.

According to an embodiment of the present invention, the tray and/or the cover are formed from a metallic material.

According to an embodiment of the present invention, the container includes a triangular shape.

According to an embodiment of the present invention, the container further includes air conduits to enable air removal from an interior of the container.

According to an embodiment of the present invention, the container further includes air notches to enable air removal from an interior of the container.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
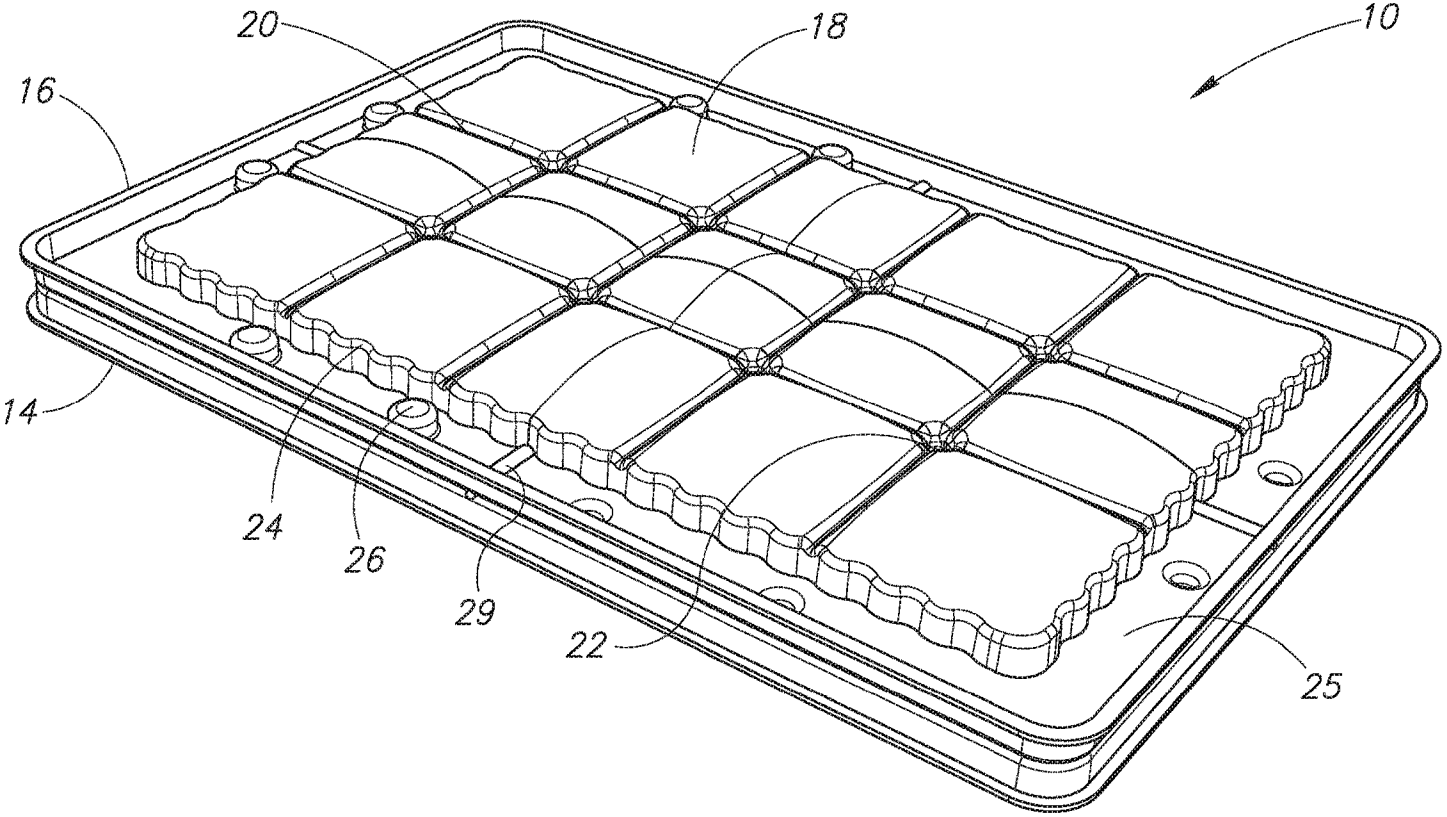
FIG. 1 is a schematic illustration of a novel food vacuum container, constructed and operative in accordance with an embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicants have realized that cooked or baked foods, such as pizzas or pies, if placed into vacuum packaging, are condensed under the vacuum pressure and lose their shape and volume. The resultant food may appear unappetizing and may lose its texture and, as a result, cannot be used for display or for sale.

Figure 2:
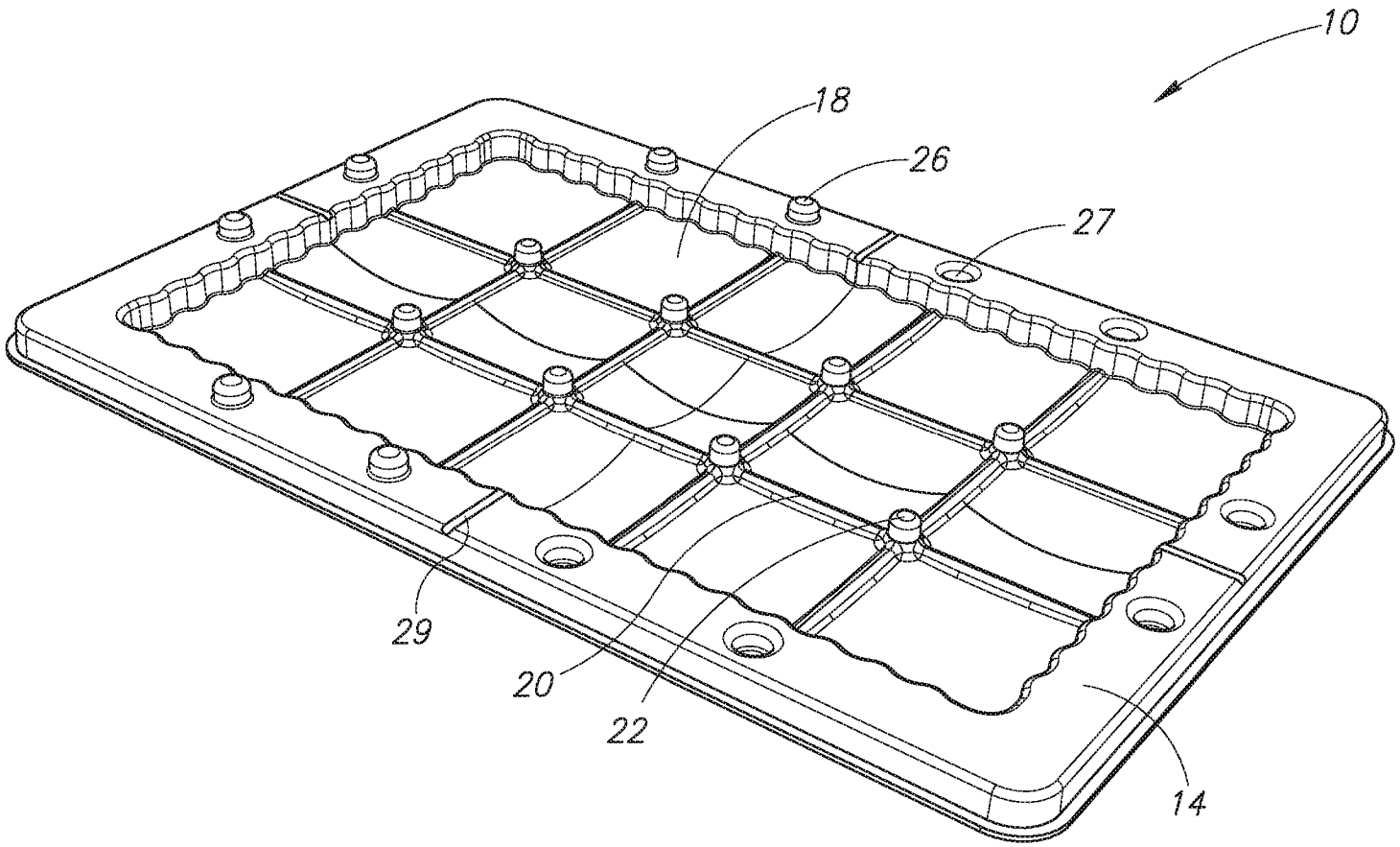
FIG. 2 is a schematic illustration of the container of FIG. 1 in which the container is open, in accordance with an embodiment of the present invention.
Figure 3:
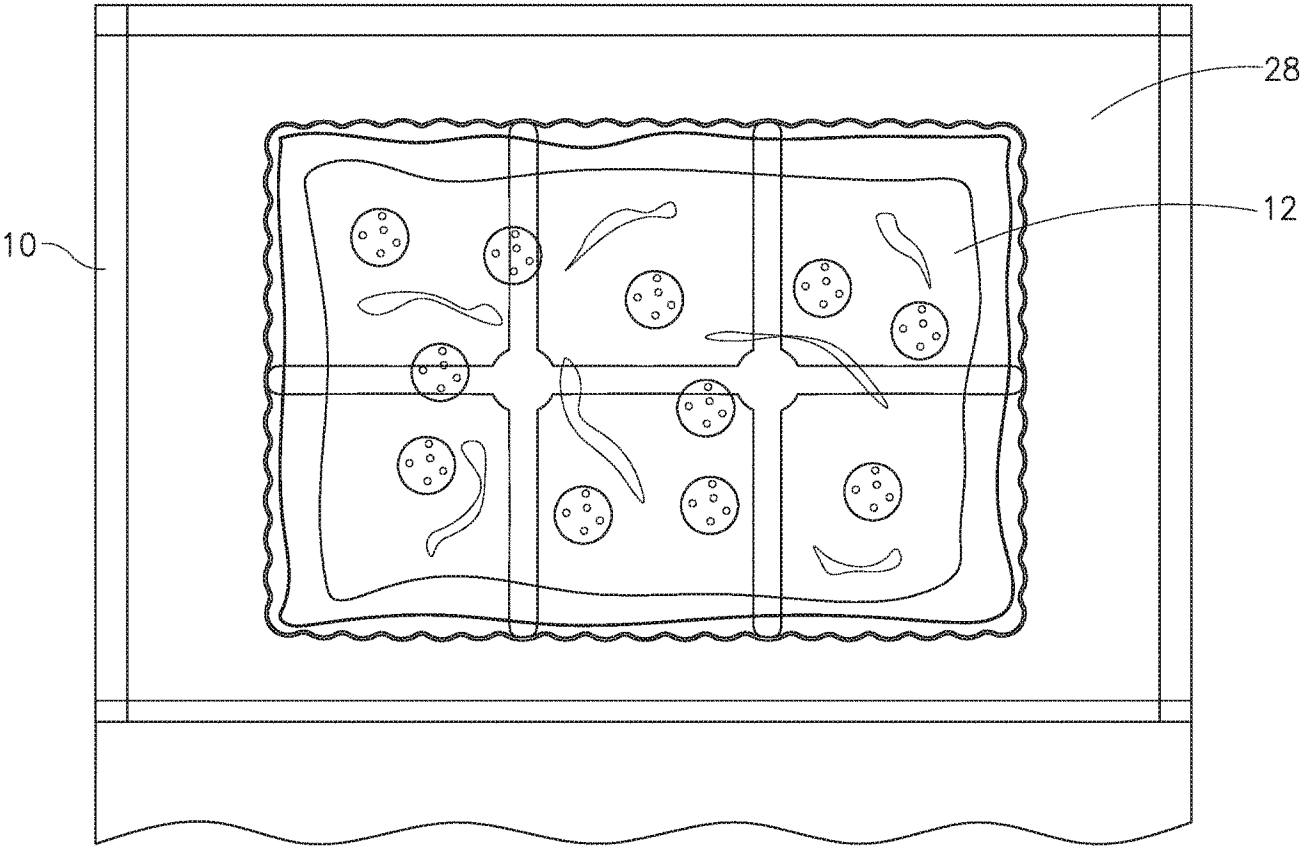
FIG. 3 is a schematic illustration of the food container of FIG. 1 containing food and sealed in a vacuum bag, in accordance with an embodiment of the present invention.
Figure 4:
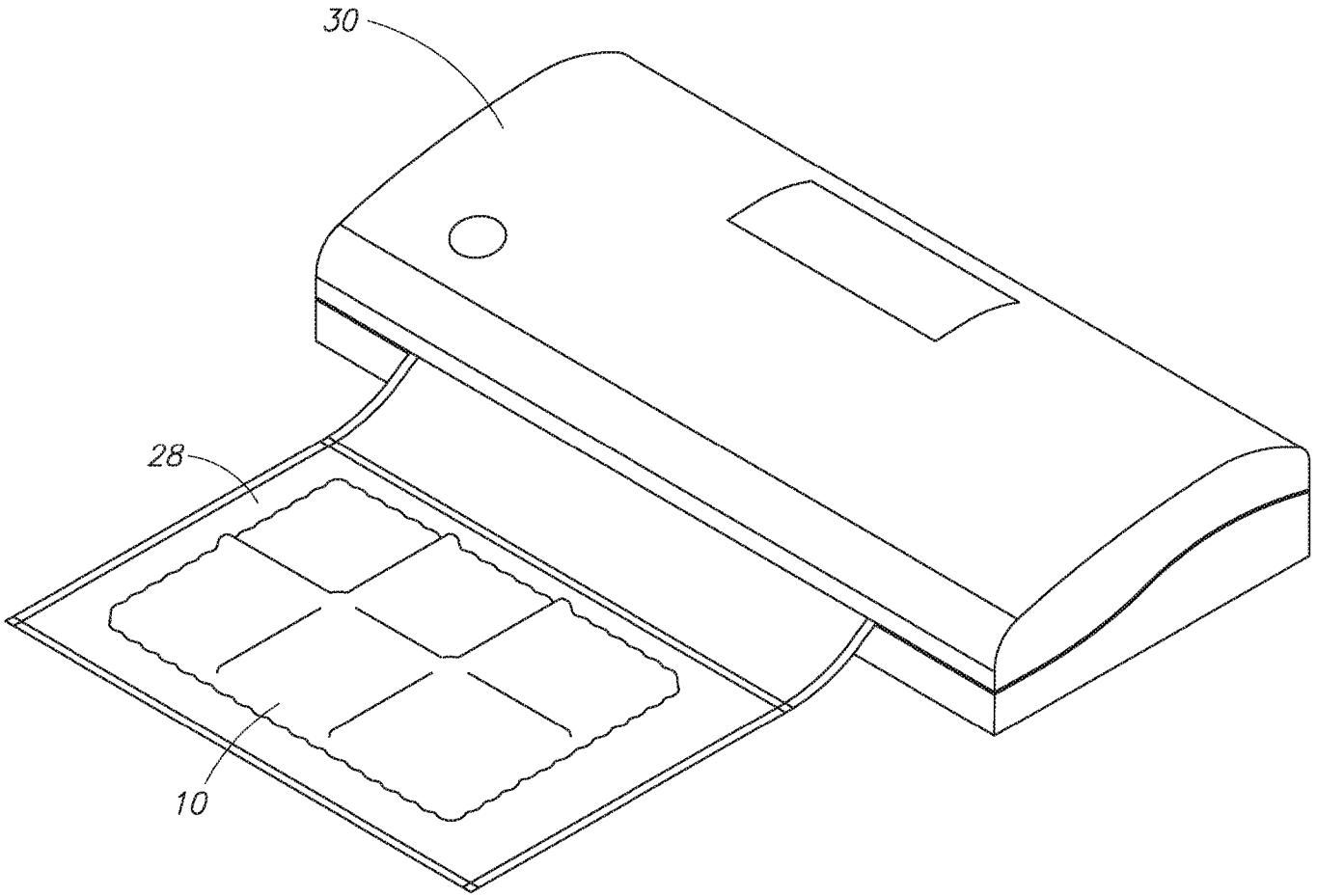
FIG. 4 is a schematic illustration of the vacuum container of FIG. 1 being sealed in a vacuum machine, in accordance with an embodiment of the present invention.

Reference is made to FIGS. 1, 2 and 3 which illustrate a novel food vacuum container 10 which maintains its shape and volume under vacuum seal conditions. FIG. 1 shows container 10 closed, FIG. 3 shows container 10 with food 12 inside, while FIG. 2 shows container 10 in an open state. Reference is further made to FIG. 4 which shows a vacuum sealing machine 30 connected to a vacuum bag 28 which may seal container 10.

In accordance with a preferred embodiment of the present invention, container 10 may store food 12 generally in a vacuum state with minimal deformation of the shape and volume of food 12. It will be appreciated that, because food 12 may be kept within a vacuum, it may be stored for a relatively long period of time and with no need to store the food in chilled or frozen conditions.

Container 10 comprises a bottom 14 and a corresponding lid 16, each of which comprises a plurality of convex load bearing units 18, canal shaped reinforcement ribs 20, circular reinforcement units 22 and scalloped edges 24. Convex load bearing units 18 may be supported by canal shaped reinforcement ribs 20, such that there is one circular reinforcement unit 22 at every rib crossing. Convex load bearing units 18 may bear external atmospheric air pressure against the internal vacuum and therefore food may be kept in container 10 without being condensed or smashed despite the internal vacuum conditions. Scalloped edges 24 may further strengthen load bearing units 18.

It will be appreciated that reinforcement unit 22 may be formed in various shapes and sizes such as horizontal support bars.

In a preferred embodiment of the present invention, bottom 14 and lid 16 may be see-through, so that people may clearly see food 12 that is inside container 10.

In another preferred embodiment of the present invention, container 10 may comprise rims 25 which have holes 27 and matching pins 26, such that bottom 14 and lid 16 may be closed and aligned when matching pins 26 go into holes 27. Rims 25 may include air conduits 29 which lead to the interior of container 10 and facilitate air removal from the interior when vacuum sealing.

As illustrated in FIG. 1, in a first preferred embodiment of the present invention, bottom 14 and lid 16 may each comprise fifteen convex load bearing units 18 supported by six canal shaped reinforcement ribs 20 with circular reinforcement units 22 at every rib crossing and scalloped edges 24 around the perimeter. Reinforcement ribs 20 may be convex or concave. It may be appreciated that reinforcement ribs 20 may include a solid cross-section, a hollow cross-section, and/or may include other shapes, such as for example, an L-shape, a T-shape, among other possible structural shapes. In some embodiments, reinforcement ribs 20 may be embedded in convex load bearing units 18 and may include a material strength greater than that of the convex load bearing units, and may withstand a pressure loading of up 2 $kg/cm^2$, for example, for example 0.5 $kg/cm^2$, 1 $kg/cm^2$, 1.5 $kg/cm^2$.

It will be appreciated that container 10 may be implemented as two separated units or connected as a single unit which may be folded over in order to be closed.

As illustrated in FIG. 3, food 12, such as a slice of pizza, may be placed into container 10, which may then be placed into a standard vacuum bag 28, such as a polyethylene bag available from Orved Corporation. Vacuum bag 28 and container 10 may be placed into a vacuum machine, as illustrated in FIG. 4, such as a vacuum sealing machine, an automatic vacuum chamber machine or a continuous vacuum machine, which may remove the air from vacuum bag 28 and may seal it, thereby removing the air from container 10. A suitable vacuum machine may be any of those commercially available from Wenzhou Packing Machinery Co. Ltd. It will be appreciated that, in accordance with a preferred embodiment of the present invention, container 10 may enable food 12 to maintain its shape, volume and position despite the vacuum seal conditions for a relatively long period of time and with no need to store the food in chilled or frozen conditions.

It will be appreciated that food 12 in container 10 may be hung for display or shipped without moving within the container, due to the fact that container 10 may be designed three dimensionally in very similar measurements to food 12 it comprises and due to the circular reinforcement units 22, which may penetrate throughout food 12 and keep it still.

It will be appreciated that, while the external pressure may be atmospheric, the internal pressure is at or is close to a vacuum so that load bearing units 18 and reinforcement ribs 20 may support a pressure differential of up to 2 $kg/cm^2$, for example 0.5 $kg/cm^2$, 1 $kg/cm^2$, 1.5 $kg/cm^2$. For example, and as shown in FIG. 1 to which reference is now briefly made, each unit 18 may be 4 cm×4 cm, each canal shaped reinforcement rib 20 may be 6 mm, with a curved upper or lower surface having a radius of curvature of 53.72 mm, and being formed of a transparent plastic such as, polyethylene or Acrylonitrile Butadiene Styrene (ABS) of 1.2 mm thickness. Other shapes, sizes and thicknesses may be possible and may be incorporated herein in the present invention.

Container 10 may be formed of a disposable plastic or other inexpensive disposable material making the container relatively inexpensive and allows its use as a disposable container.

Figure 5:
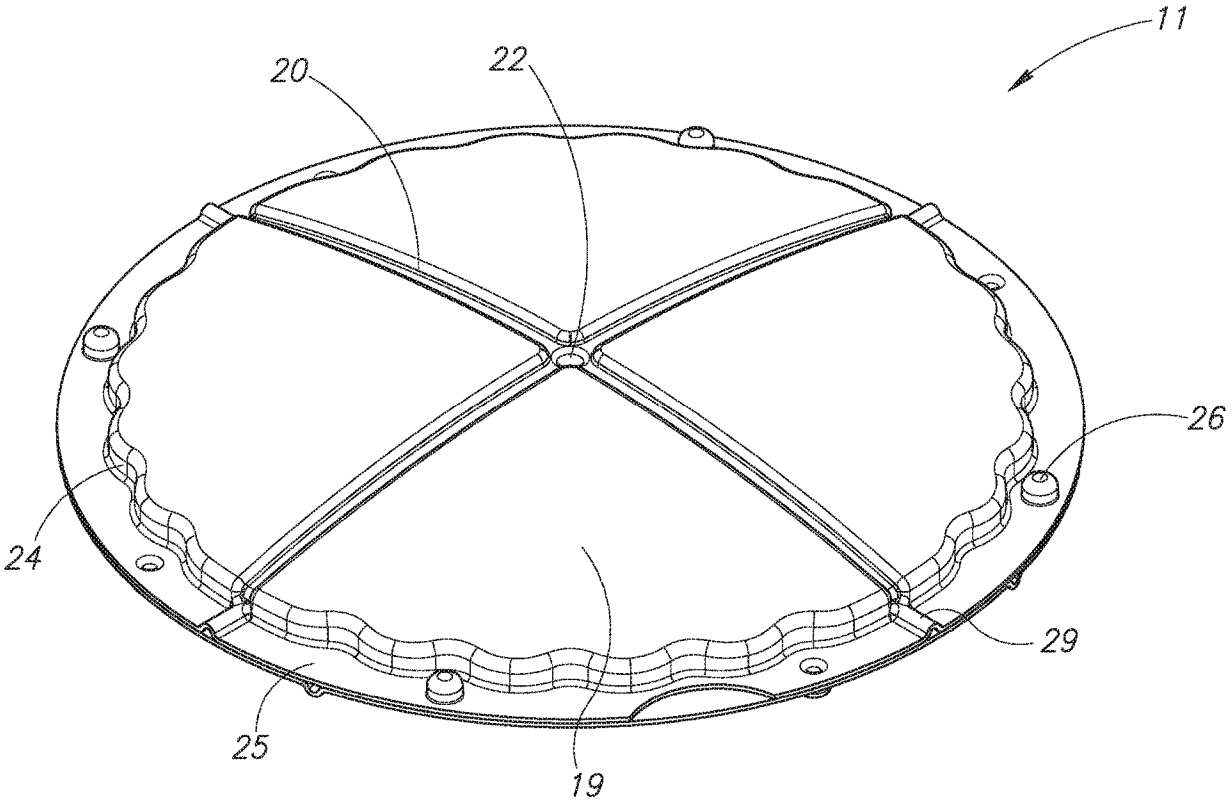
FIGS. 5, 6 and 7 are schematic illustrations of alternative embodiments of the novel food vacuum container of FIG. 1, constructed and operative in accordance with alternative embodiments of the present invention.

Reference is now made to FIG. 5, which illustrates another preferred embodiment of the present invention. FIG. 5 shows a round container 11, comprising four pie slice shaped, convex load bearing units 19, which may be supported by two canal shaped reinforcement ribs 20 with a circular reinforcement unit 22 at the rib crossing. As in the previous embodiment, container 11 may comprise scalloped edges 24. Other round containers may have different number of convex load bearing units 19 and thus different number of canal shaped reinforcement ribs 20 and circular reinforcement units 22. Container 11 may include a rim 25 with air conduits 29 which lead to the interior of the container and facilitate air removal from the interior when vacuum sealing.

Figure 6:
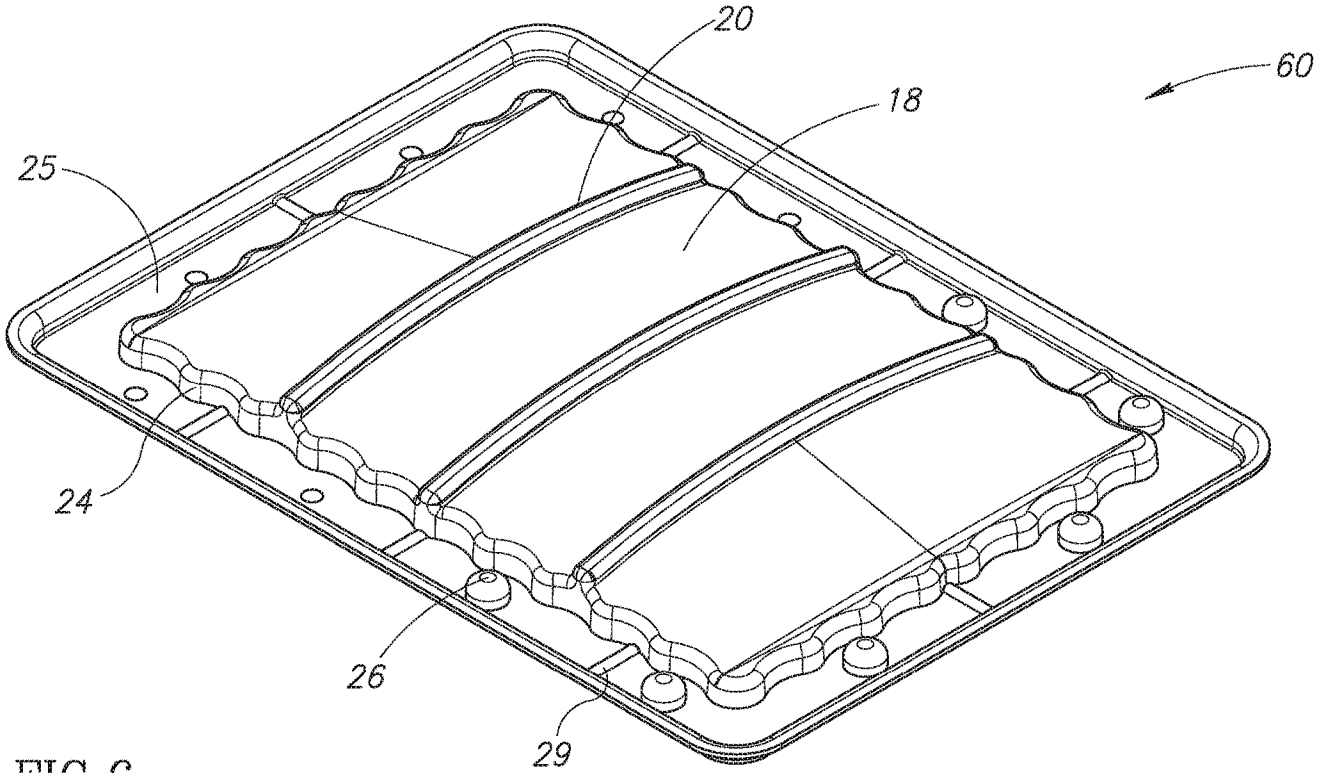

Reference is now made to FIG. 6, which illustrates another preferred embodiment of the present invention. FIG. 6 shows a container 60 comprising convex load bearing units 18 with no circular reinforcement units 22 as in container 10. Reinforcement ribs 20 may be thicker in order to strengthen the load bearing units. Reinforcement ribs 20 may be convex or concave. As in the previous embodiments, container 60 may comprise scalloped edges 24. Container 60 may include a rim 25 with air conduits 29 which lead to the interior of the container and facilitate air removal from the interior when vacuum sealing.

Figure 7:
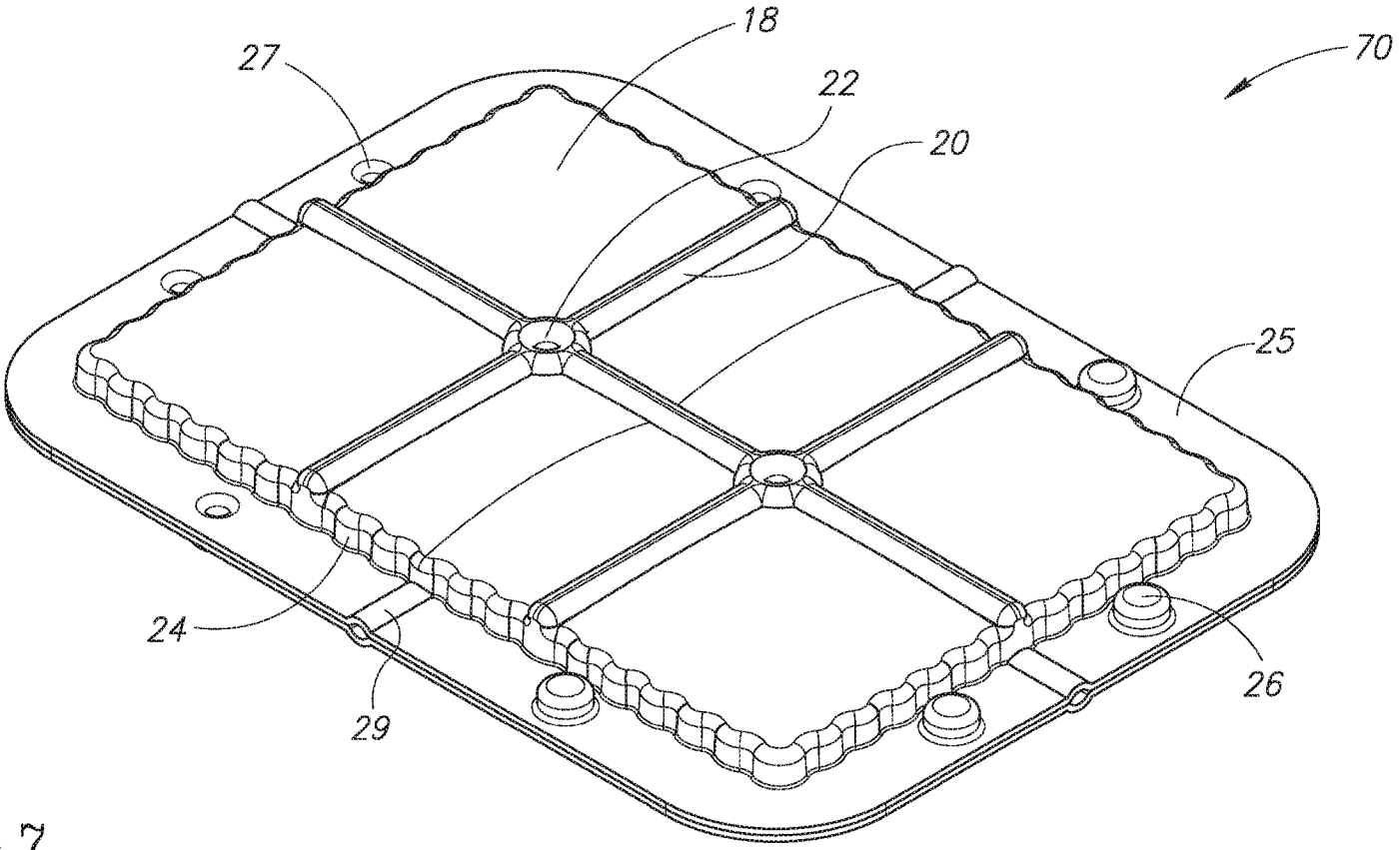

Reference is now made to FIG. 7, which illustrates a preferred embodiment of the present invention in which a container 70 comprises six convex load bearing units 18 supported by three canal shaped reinforcement ribs 20 with a circular reinforcement unit 22 at each of the two rib crossing, as well as having scalloped edges. Container 70 may include a rim 25 with air conduits 29 which lead to the interior of the container and facilitate air removal from the interior when vacuum sealing. In this embodiment, container 70 may be 12 cm long and 8 cm wide.

Figure 8:
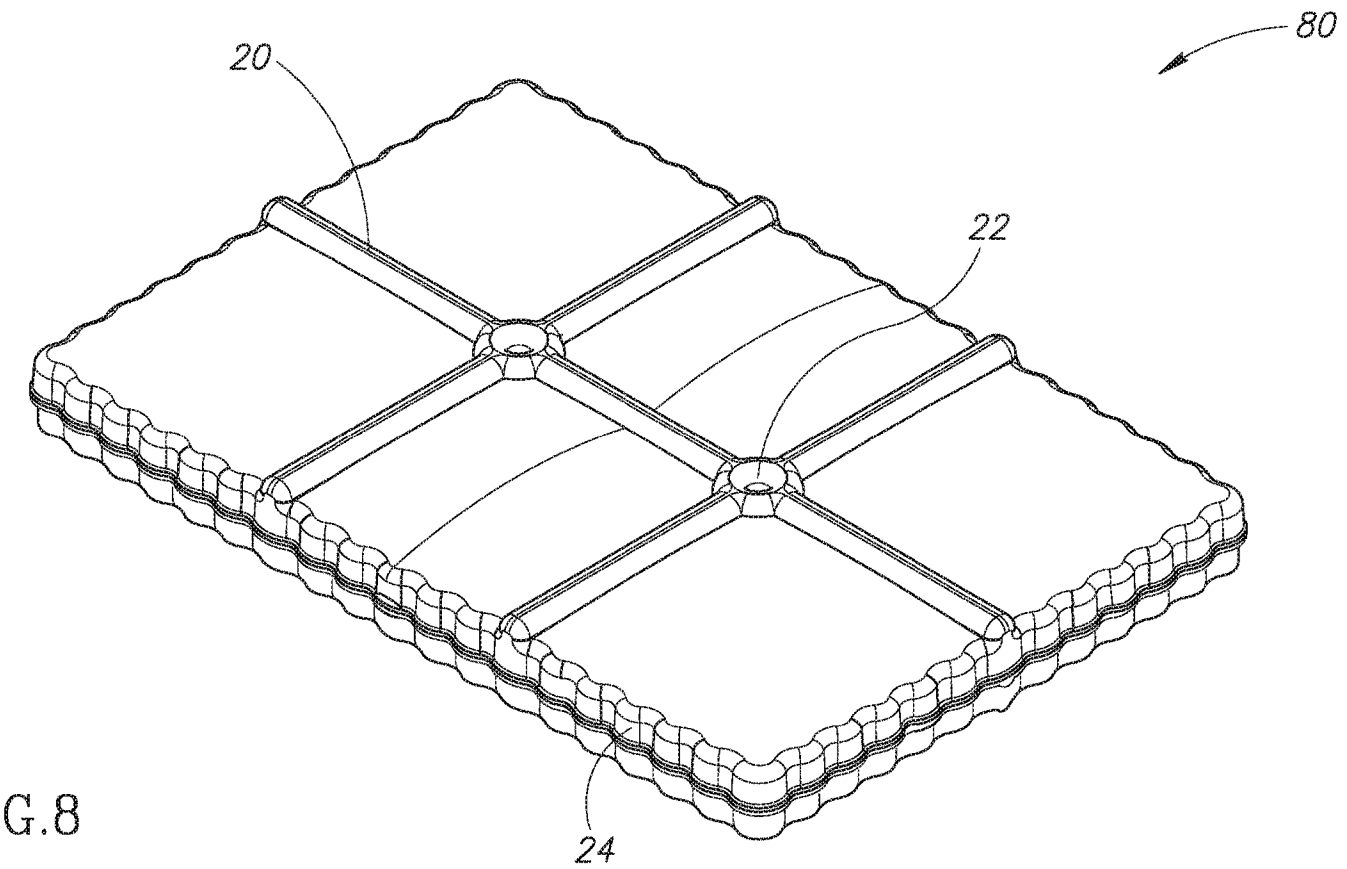
FIG. 8 is a schematic illustration of a novel food vacuum container according to another embodiment of the present invention, in which the container does not have rims.

Reference is now made to FIG. 8, which illustrates a preferred embodiment of the present invention in which a container 80 does not have rims 25 as in container 10.

Figure 9:
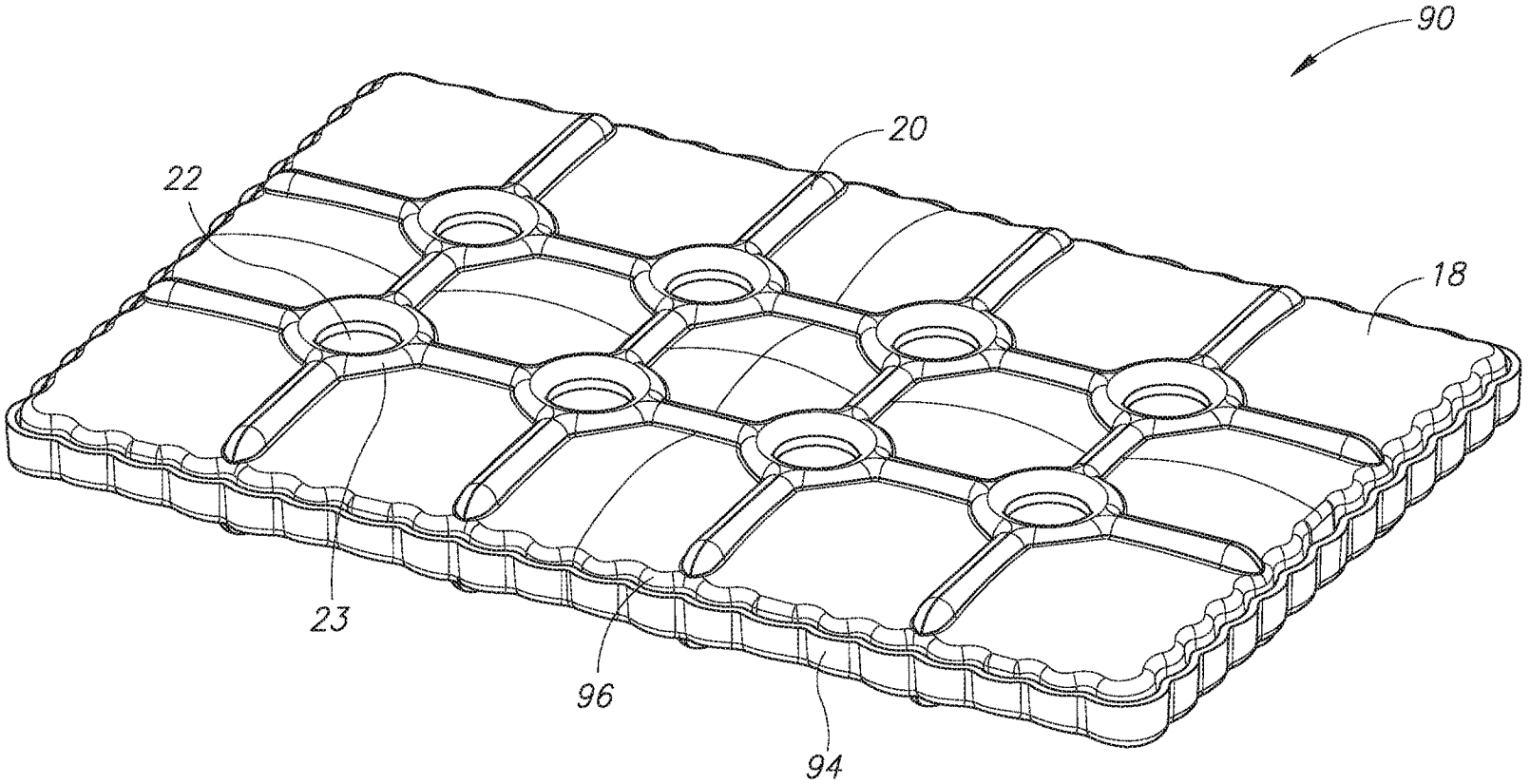
FIG. 9 is a schematic illustration of a rim-less novel food vacuum container according to another embodiment of the present invention.
Figure 10:
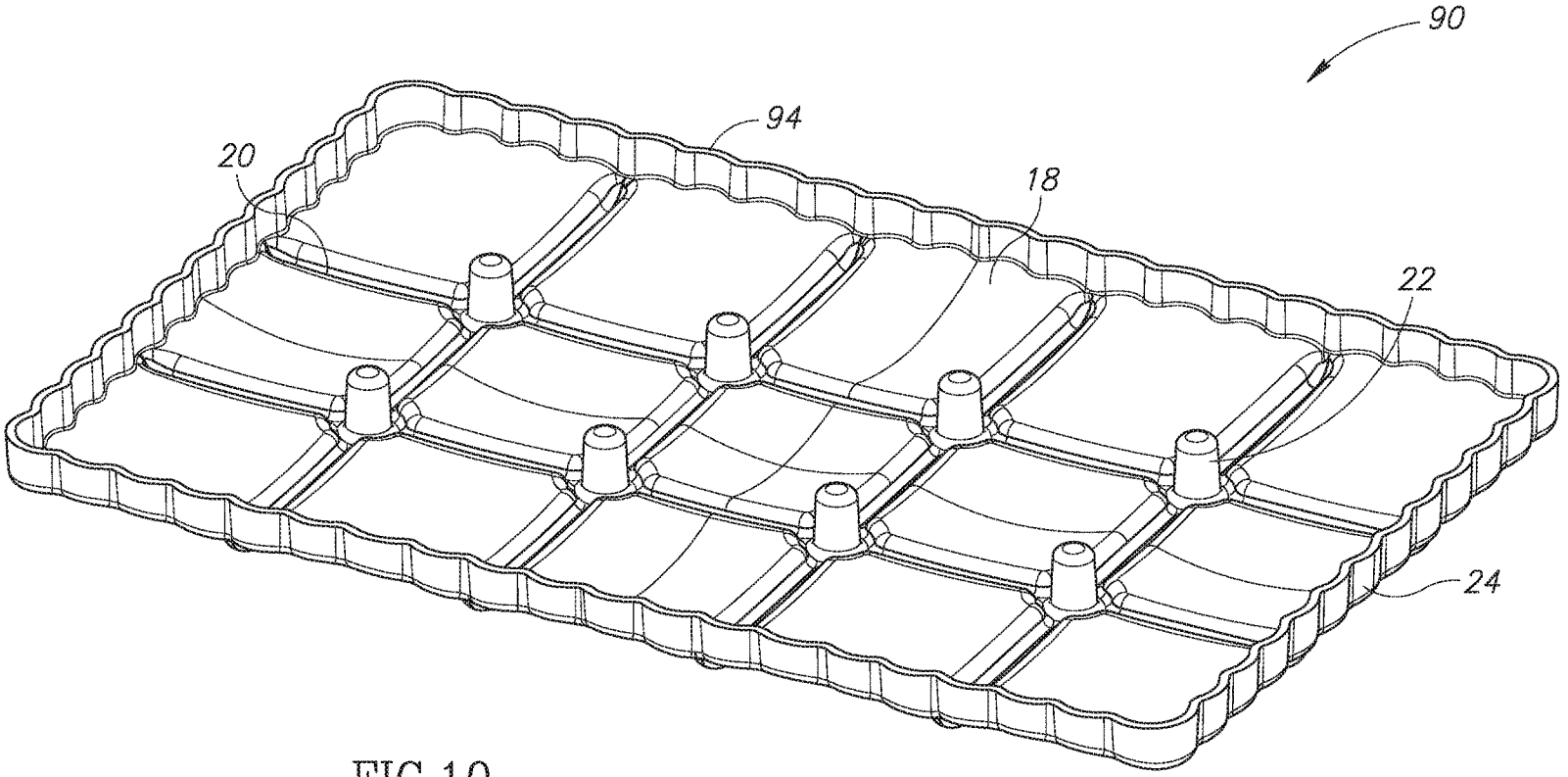
FIG. 10 is a schematic illustration of a bottom tray of the vacuum container of FIG. 9, in accordance with an embodiment of the present invention.
Figure 11:
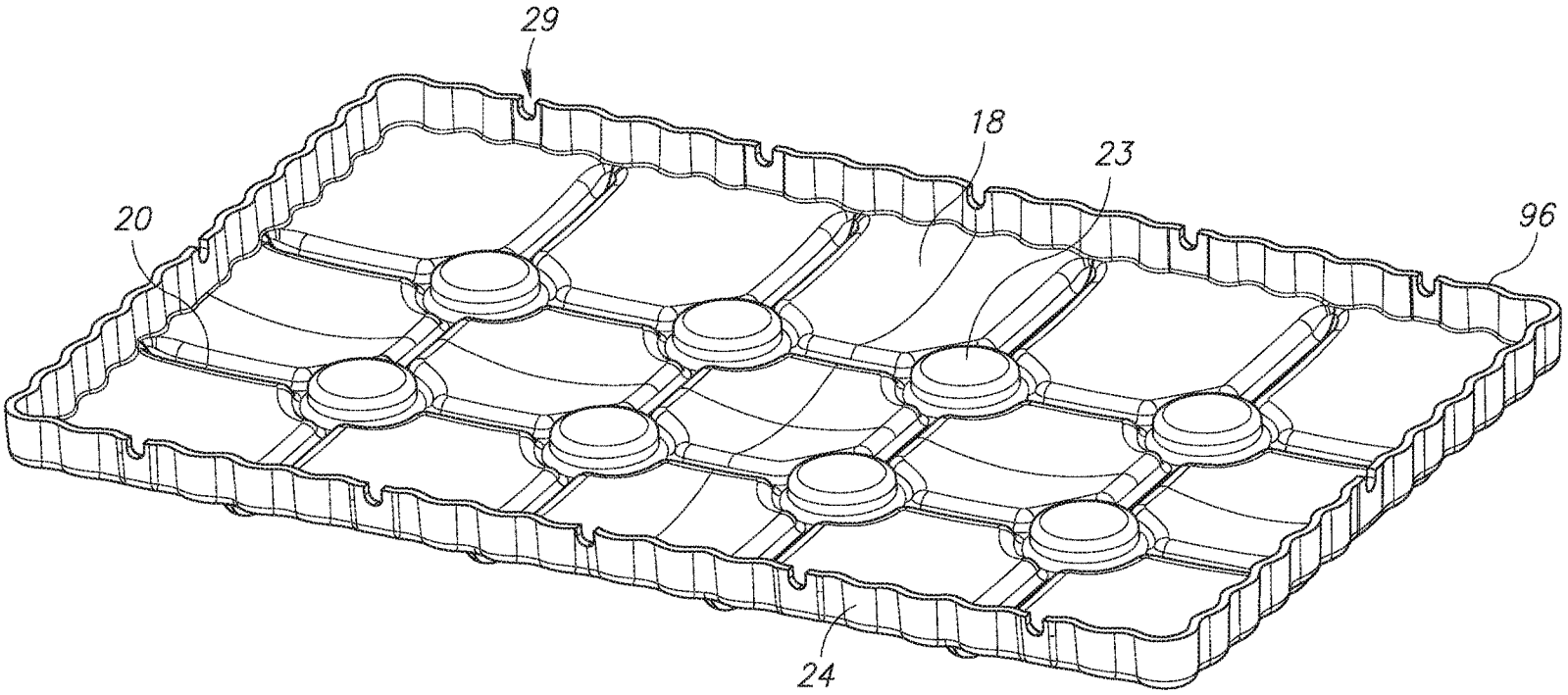
FIG. 11 is a schematic illustration of a lid of the vacuum container of FIG. 9, in accordance with an embodiment of the present invention.

Reference is now made to FIGS. 9-11, which schematically illustrate a rim-less food vacuum container 90 with 15 load bearing units 18, in accordance with an embodiment of the present invention. Container 90 includes a bottom tray section 94 (FIG. 10) and a cover (lid) 96 which correspondingly fits onto the bottom section. Load bearing units 18 are supported by canal shaped ribs 20, a total of eighteen, used to support the 15 load bearing units. Circular reinforcement units 23 are located at every rib crossing and may serve both to reinforce the ribs and the load bearing units 18. Circular reinforcement units 23 may include pins 22 which may penetrate into the food to prevent movement. Both bottom tray 94 and cover 96 include scalloped shaped edges 24 which may serve to further reinforce load bearing units 18. Notches 29 on cover 96 may allow air to be more easily drawn out from inside container 90 during vacuum sealing of the container. Additionally or alternatively, notches 29 may be included in bottom tray 94.

It will be appreciated that the strength of containers 10-90 may be created by a combination of two or more elements such as the thickness of the containers, the thickness of rims 25, the width and number of reinforcement ribs 20, the curve of load bearing units 18, the size of circular reinforcement units 22, the size of scalloped edges 24 and the amount of vacuum in the containers.

In a preferred embodiment the thickness of the containers is between 0.5 mm to 2.5 mm.

In another preferred embodiment, the amount of vacuum in the containers is above 90%.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A vacuum sealable container for baked or cooked food, the container comprising:

a tray and a cover correspondingly fitting onto said tray and defining an interior of said container there between;

each of said tray and cover having air conduits therein to said interior, wherein at least one of said tray and said cover comprises:

a rim;

a vertically upwardly extending scalloped edge along an inner side of said rim; and two or more load bearing units, each comprising a slightly outwardly curved, horizontally extended top surface supported by one of:

said scalloped edge, said scalloped edge and at least one reinforcement rib, and said scalloped edge, and at least two reinforcement ribs and at least one reinforcement unit for supporting said reinforcement ribs, placed at the intersection of said at least two reinforcement ribs, wherein said load bearing units in their entirety resist deformation when air is removed through said air conduits from said interior to create a vacuum within the container when an exterior of the container is at ambient atmospheric pressure.

2. A container according to claim 1 wherein said reinforcement ribs comprise a cross-section shaped in the form of at least one of a U-shape, a T-shape, an L-shape, a circle, or a polygon.

3. A container according to claim 1 where said tray and said cover are formed from a plastic material.

4. A container according to claim 3 wherein said plastic material is transparent.

5. A container according to claim 3 wherein said plastic material is colored.

6. A container according to claim 1 wherein said tray and said cover include means for aligning one with the other.

7. A container according to claim 1 comprising one or more pins, rods, or blades for penetrating into the food.

8. A container according to claim 1 wherein the container comprises a rectangular shape.

9. A container according to claim 1 wherein the container comprises a round shape.

10. A container according to claim 1 wherein a perimeter of said load bearing units is square-shaped.

11. A container according to claim 1 wherein a perimeter of said load bearing units is pie-shaped.

12. A container according to claim 1 wherein said tray and/or said cover are formed from a metallic material.

13. A container according to claim 1 wherein the container comprises a triangular shape.

14. A container according to claim 1, wherein each said load bearing unit is 16 $cm^2$, each reinforcement rib is 6 mm thick, a radius of curvature of said top surface is 53.72 mm, and said container is formed of transparent plastic which is 1.2 mm thick.

15. A vacuum sealable container for baked or cooked food, the container comprising:

a tray and a cover correspondingly fitting onto said tray and defining an interior of said container there between;

each of said tray and cover having air conduits therein to said interior, wherein at least one of said tray and said cover comprises:

a rim;

a vertically upwardly extending scalloped edge along an inner side of said rim; and two or more load bearing units, each comprising a slightly outwardly curved, horizontally extended top surface supported by one of:

said scalloped edge, said scalloped edge and at least one reinforcement rib, and said scalloped edge, and at least two reinforcement ribs and at least one reinforcement unit for supporting said reinforcement ribs, placed at the intersection of said at least two reinforcement ribs, wherein said load bearing units in their entirety resist deformation when air is removed through said air conduits from said interior to create a vacuum within the container when an exterior of the container is at ambient atmospheric pressure, and wherein said load bearing units resist deformation when a pressure differential between said interior package sealing vacuum and said external ambient pressure is at least 1 $kg/cm^2$.

* * * * *